US008397813B2

(12) United States Patent
Brandsdal

(10) Patent No.: US 8,397,813 B2
(45) Date of Patent: Mar. 19, 2013

(54) DEVICE FOR A TEST PLUG

(75) Inventor: Viggo Brandsdal, Ytre Arna (NO)

(73) Assignee: TCO AS, Bergen (NO)

( * ) Notice: Subject to any disclaimer, the term of this patent is extended or adjusted under 35 U.S.C. 154(b) by 539 days.

(21) Appl. No.: 12/450,921

(22) PCT Filed: Apr. 17, 2008

(86) PCT No.: PCT/IN2008/000138

§ 371 (c)(1),
(2), (4) Date: Nov. 19, 2009

(87) PCT Pub. No.: WO2008/127126

PCT Pub. Date: Oct. 23, 2008

(65) Prior Publication Data

US 2010/0163222 A1 Jul. 1, 2010

(30) Foreign Application Priority Data

Apr. 17, 2007 (NO) ..... 20071973

(51) Int. Cl.
*E21B 33/00* (2006.01)

(52) U.S. Cl. ..... 166/285; 166/299; 166/376; 166/317; 166/192

(58) Field of Classification Search ..... 166/285, 166/299, 376, 317, 192, 386
See application file for complete search history.

(56) References Cited

U.S. PATENT DOCUMENTS

| | | | | |
|---|---|---|---|---|
| 3,087,549 | A | 4/1963 | Brunton | |
| 3,557,701 | A * | 1/1971 | Arnell | 102/260 |
| 5,188,183 | A * | 2/1993 | Hopmann et al. | 166/387 |
| 6,092,601 | A | 7/2000 | Gano | |
| 2003/0168214 | A1 | 9/2003 | Sollesnes | |
| 2006/0021748 | A1 | 2/2006 | Swor | |
| 2007/0012438 | A1 * | 1/2007 | Hassel-Sorensen | 166/192 |

FOREIGN PATENT DOCUMENTS

| | | |
|---|---|---|
| GB | 2 256 366 A | 11/1992 |
| NO | 321976 | 5/2005 |
| WO | WO 2004/072438 A | 8/2004 |
| WO | WO 2005/049961 | 6/2005 |

* cited by examiner

*Primary Examiner* — Giovanna Wright
*Assistant Examiner* — Ronald Runyan
(74) *Attorney, Agent, or Firm* — Francis C. Hand; Carella, Byrne, et al

(57) ABSTRACT

A plug (20) is described for carrying out tests of a well (30), a pipe or the like, comprising an explosive charge (55) with an activation mechanism (50, 51, 53) and which is detonated to remove the plug when the test is completed, and the plug is characterized in that the explosive charge elements are arranged internally in the plug. The plug preferably comprises a boring (54) that holds said explosive charge (55) with the activation mechanism, and it can alternatively comprise two or more borings (54) for the placing of a corresponding number of explosive charges (55) with activation mechanisms. The explosive charge (55) with ignitor (56) and ignition pin (57) is preferably arranged in the plug boring (54) while the other parts (50, 51, 53) of the activation mechanism are integrated in the wall of the pipe bundle (10) that holds the plug.

12 Claims, 3 Drawing Sheets

Prior art

DEVICE FOR A TEST PLUG

The present invention relates to a plug construction comprising an explosive charge.

It is well known that production wells in the oil industry must be tested before they can be taken into use. One of these tests is to control that the components of the well withstand the pressure at which the well operates under during the production of oil/gas. To carry out such tests, a plug, such as a crushable plug made of glass, is placed down in the production pipe in the well to close off the passage into it. When the pipe is pressurised from the surface with a suitable fluid, one can, over time, control that the well is sufficiently tight against leaks. When the testing is over, the plug is removed in a controlled explosion.

As a rule, explosive charges are placed on the top side of the glass plug. Many mechanisms can be used to activate such explosive charges.

Previously, plugs were used which could be pulled out after use, but later plugs which can be either opened, broken or dissolved after use, have been used.

With regard to prior art, reference is made to Norwegian Patent 321.976 and U.S. Pat. No. 5,607,017 and US 2003/0168214.

NO 321976 describes a test plug of ceramics/glass that comprises an explosive charge and that this explosive charge is placed on the top surface of the plug, approximately as shown in FIG. 1 (prior art) in the present invention. The explosive charge is consequently not arranged inside the plug as is the case for the present invention.

Furthermore, U.S. Pat. No. 5,607,017 describes a core material which shall be dissolved when it comes in contact with well fluid such that the fluid can flow freely. Thus the US patent does not describe application of plugs where the explosives are integrated in the plug itself as is the case for the present invention.

Even with the new solutions, it often happens that remains from the fitting tube (housing) for the explosive charge create problems in the pipe.

With the invention one aims to further develop the above mentioned described constructions.

In addition, one aims to eliminate, completely or partially, the problems with the unwanted remains from the fitting housing for the explosive charge that come out into the fluid stream and which cause problems for the operator of the field.

Today's directed charge leads to limited crushing as it must penetrate the whole of the plug element and a crushing on the underside is not optimal with the current systems.

In addition one aims to provide a solution that increases the safety and reduces or eliminates the risk of unintended explosion if one has to apply supporting tools to remove the glass plug because the explosion mechanism fails or does not succeed in blowing the glass plug loose from its seat.

The plug, according to the invention, is characterised in that the explosive charge elements are arranged internally in the plug.

The plug preferably encompasses a boring that can hold said explosive charge with activation mechanism. The plug preferably comprises two or more borings for the placing of a corresponding number of explosive charges with activation mechanisms.

When a charge is applied which is placed inside the glass itself, one can obtain a solution which does not leave large remains in the well that can disturb the further operation of the well. This would be an essential and necessary improvement to be able to deliver to all types of wells. Placing the explosive charge in the crushable glass itself has been tested and it appears to be giving a very thorough crushing. Furthermore, it is greatly advantageous that large parts of the associated instrumentation are fitted in the casing lying radially outside in which the plug and the explosive charge itself are fitted.

It is a great advantage of the present invention that the new explosive charge works from the inside of the plug element and that one only needs enough explosives to just crush half of the thickness of the glass plug in relation to where the explosive charge is placed on top of the glass plug. Thereby, there is no need for so much explosive material which can thereby be reduced compared to what we required previously.

The solution according to the present invention is based on standard, off-the-shelf products for the equipment that is required. This makes it possible for the ignitor to be fitted offshore before the fitting in the plug shall take place. Safety wise, this is a better solution and transportation to most production fields becomes easier than for today's solutions.

Today's explosive charges are also based on off-the-shelf goods, but here an ignitor and primary explosives are placed into a common housing when they are put to the market. This is not desirable as it requires the strictest safety classification for transport of explosives.

With the explosive charge inserted into the glass plug itself, the plug system and the trigger system can be pressure tested with no risk of detonation as the explosives are installation tested or pressure tested via an opening on the side of the plug.

This can not be carried out with today's systems as the explosives are fitted in the same housing which triggers and thereby will detonate them by leakage.

The solution according to the present invention functions in that an axial, hydraulic force released by either an electric signal, ultrasound, acoustics or hydraulic pulses in the well is transformed to a radial, mechanical movement which starts the ignition which in turn detonates the explosives lying inside the glass plug.

Today's systems use an axial hydraulic movement which sets off the ignitor that is also fitted axially on top of the plug element itself.

The solution according to the present invention does not need its own housing which must be able to withstand pressure up to 800 bar as the plug element itself makes up this housing and protects the explosives against the fluid environment in the well.

With the invention one also achieves a great improvement with regard to waste material in the form of loose parts that come from the explosion and considerably more tolerance with respect to influences in the well when it comes to loose parts, deposits and articles that fall down onto the plug body for different reasons. This solution also makes it possible to communicate through other hollow spaces in the string where the plug is located. This will help in increasing the reliability of the solution as its function is not influenced by deposits and loose parts.

Today's charges must have their own housing which must be able to withstand pressure differences of a minimum of 800 bar, as this housing will leave aluminium remains or other material remains in the well.

The present solution leads to a very good solution with regard to use of supporting tools to crush the plug as the ignitors and the explosive charges are protected by the plug element, and they will always be exposed to well fluid when the plug element around it is removed. This is a very essential point for the product to be user friendly. However such a plug is removed, there will always be undetonated explosives in the well afterwards.

With today's solutions one always gets a theoretical possibility that there may be undetonated explosives left in the well after use of support tools. Even if this possibility is theoretical, it is not acceptable to the operators of the field.

By placing explosives in the plug element and detonating it there, the amount of explosives is considerably reduced from 60-70 grams used in today's system to 10-15 grams used in the new solution.

With the large amount of explosives used today, there is a great risk of the pipe housing being influenced so strongly that the plug housing is given a bulge or a protrusion in some cases. It is very undesirable that the pipe has such protrusions.

With the present invention the reduced amount of explosives reduces the risk of the plug housing bulging out (ballooning) at the explosion. One gets a more controlled crushing at the same time as one does not get unwanted incidents due to the smaller amount of explosives used.

The inventions shall now be described in more detail with reference to the enclosed figures in which.

Figure 1:
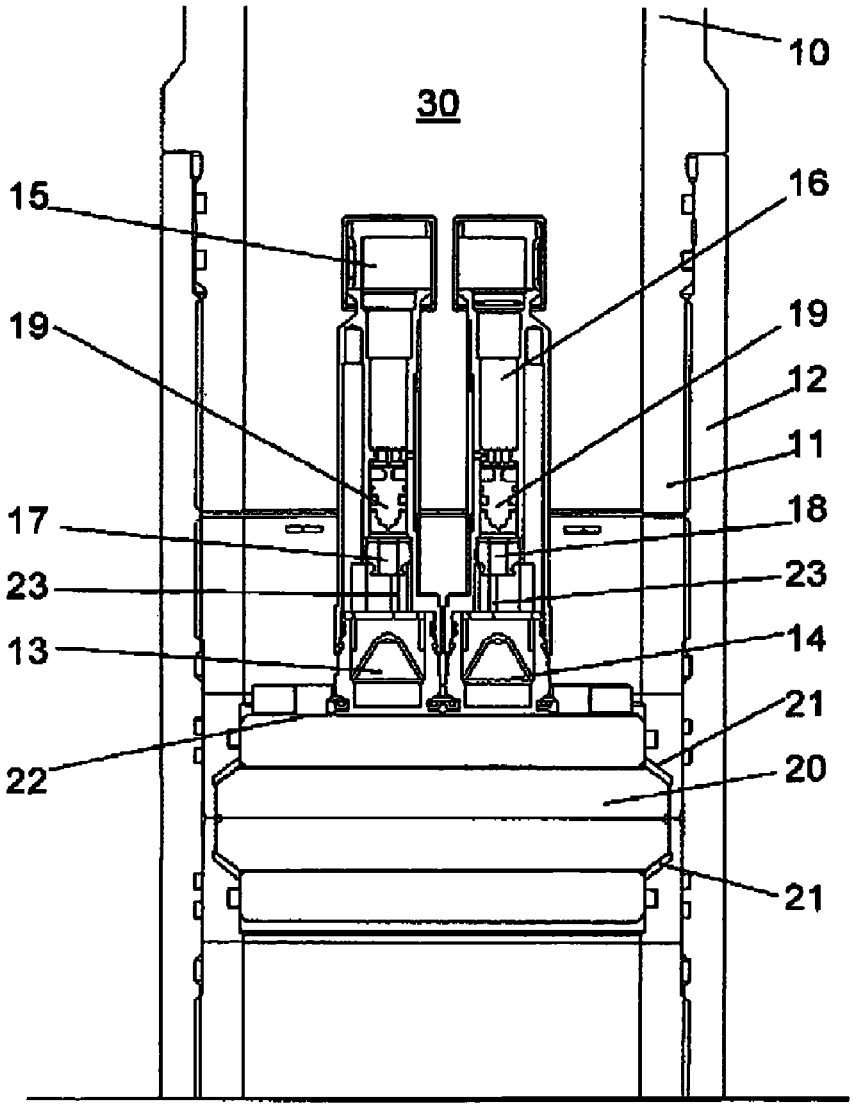
FIG. 1 shows a vertical section of a known solution with a glass plug and explosive bodies placed on the top side of the plug.

Initially, reference is made to FIG. 1 which illustrates a typical known solution where a plug 20 is fitted inside a pipe bundle 11 which is inserted in a production pipe/casing pipe 10 in the well 30 that runs through a formation 12 in an oil carrying/gas carrying formation. The explosive elements in the form of two column-formed bodies 15,16 are placed on the top side 22 of the crushable plug 20 (glass, ceramics or the like).

The plug 20, hereafter only termed a glass plug, is inserted in the well 30 to carry out pressure testing of the well to control that all parts are sufficiently leak proof and can hold a given pressure of fluid.

When these tests have been carried out, the plug 20 is removed in that it is exploded with the two explosive charges 13,14. The explosion can take place in many ways. A normal way is that well fluid, with a given pressure, is let into the inner parts of the explosive charge housing 15,16 so that an ignition pin 19 is pushed down and hits an ignitor 23,17,18 which initiates the ignition of the underlying explosive charge 13,14. The glass is thus burst into a fine dust that does not cause any damage in the well. The elements 15,16 themselves are also exploded into small bits. Explosion elements of the type shown in FIG. 1, leave several larger fragments in the fluid stream (termed debris) which are not wanted.

It is a part of the aim of the invention to provide a solution where the explosive elements have a smaller size, have less weight and have less material, such that the amount of fragments is much reduced.

The present invention is characterised in that the explosive element 15 or the elements (15,16) is placed internally in the plug element 20 itself as described in the characteristic in the claim 1 given below.

Figure 2:
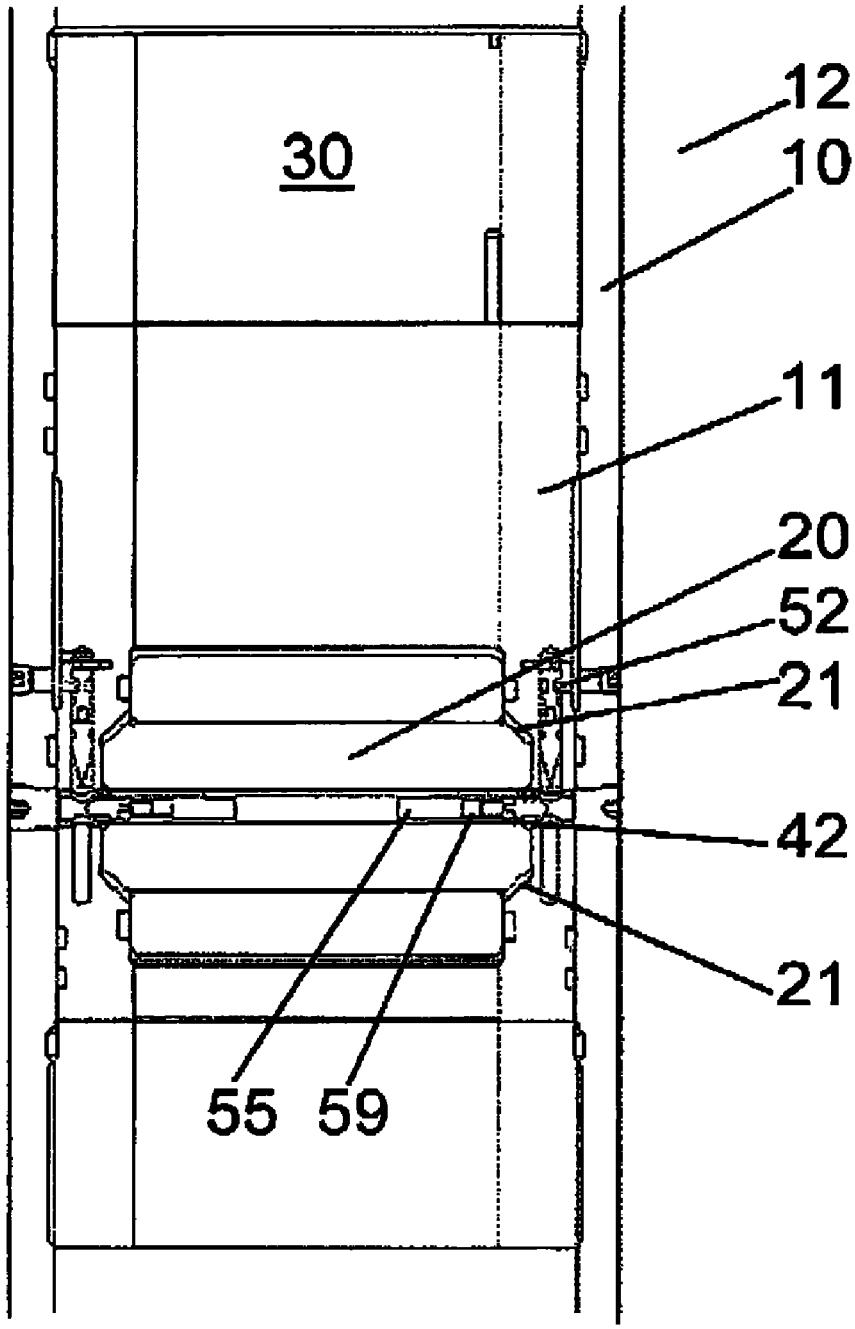
FIG. 2 shows a vertical section of the new solution according to the invention.
Figure 3:
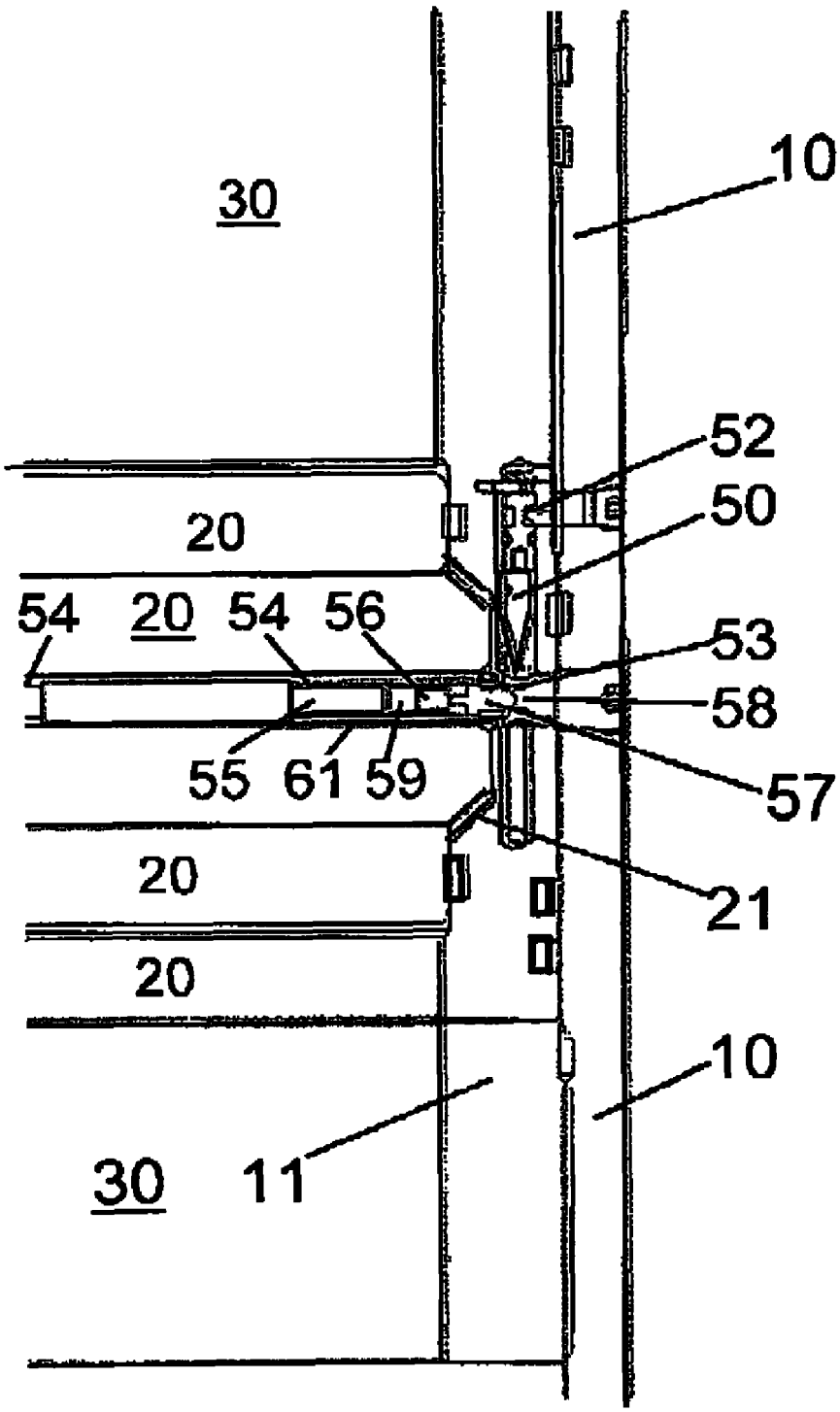
FIG. 3 shows an enlarged detail of FIG. 2.

The present invention is shown in the longitudinally running vertical sections shown in FIGS. 2 and 3, with FIG. 3 showing an enlarged section of FIG. 2.

FIG. 2 shows a pipe bundle 10/11 with a glass plug 20 that is inserted in a production pipe/casing pipe in the well 30 that runs through a formation 12 in an oil carrying/gas carrying formation 12. A first explosion element 40 is fitted on the one side in the glass plug 20 and a second explosion element 42 on the other side, i.e. the explosion elements are diametrically opposite in relation to each other.

With reference to the enlarged section in FIG. 3, ignition mechanisms are fitted in the outer pipe casing 10 of the plug section that holds the glass plug 20 in its seat 21, comprising mechanical bodies that cause initiation of the explosion.

As can be seen in the section in FIG. 3, these bodies comprise a downwardly movable, wedge-formed element 50 which is integrated into the pipe casing 10, which is activated to a downward movement in the same way as the constructions inside the explosion elements 15,16 according to FIG. 1. The wedge 50 is held in place in the pipe wall ready for activation of breaking/explosion pins 52. Below the wedge 50 there is a hollow space 53 in the pipe that makes the connection to the explosive charge system itself, which is now, according to the invention, fitted in a boring internally in the plug itself.

The top side of the wedge 50 is connected via fluid with the fluid volume 30 inside the pipe on the top side of the plug.

An approximately horizontal channel 54 is bored out in the plug 20 and the explosive charge is inserted into this channel, comprising the explosive charge 55, the ignition element 56 and an ignition pin 57, in that order. The elements are preferably fitted in advance in a closed casing 61, such as made from plastic or the like, and which is then inserted in the channel 54 in the glass plug 20. Necessary safeguards that prevent the explosion from happening unintentionally are in place. The ignition element 56 (the ignitor) lies consequently between the charge 55 and the ignition pin 57. Furthermore, there is a shorter air pocket 59 between the charge 55 and the ignitor 56.

These elements may be moulded in the casing of the plug while being manufactured in the workshop.

The rear end 58 of the ignition pin 57 extends out into the space 53. When the wedge 50 is pushed downwards, it pushes against the rear end of the ignition pin 57 so that the axial movement of the wedge 50 leads to the ignition pin 57 being pushed radially inwards. The ignition pin 57 "shoots" thereby into the ignition 56 which then explodes and further detonates the large explosive charge 55 further inside the channel 54. Thus the glass plug 20 is blown into bits.

According to a preferred embodiment a corresponding explosion system is fitted on the diametrically opposite side in the glass plug, as can be seen in FIG. 2.

Several such explosion elements can be fitted if necessary in the glass plug around the whole of the glass plug, for example 3, 4 or more. As mentioned, the axial movement of the wedge 50 is activated under the influence of a hydraulic force, as this can be activated either by an electric signal, ultra sound, acoustically or by establishing hydraulic pressure pulses in the well volume 30 above the glass plug. In the last case, there is a fluid connection between the well volume 30 and the top side of the wedge 50. The wedge 50 can also be fitted with a spring (not shown) which is held in place with the help of stop-pins, and on activation, the stop-pins become loose so that the spring pushes the wedge 50 downwards with sufficient power to push the ignition pin 57 radially inwards.

It will be clear that in the system according to the invention, the activation mechanism is divided in two, in that the essential parts such as the ignition pin, the ignitor and the explosive charge are inserted in the glass itself, while the remainder of the activation mechanism is arranged in the outer pipe casing which also comprises the seat 21 of the glass plug.

In the previous solution (FIG. 1) all these mechanisms are fitted in separate casing bundles which are then placed on top of the plug.

According to the invention, it is preferred (most practical) that the explosive charges are inserted in largely horizontal borings in the glass plug, but they can also be arranged in different inclined positions in the glass plug as required.

With the present invention a large technical step forward is provided in the area related to test plugs.

One of the great advantages is that essential and necessary metal parts of the activation mechanism are fitted into the plug pipe and not in connection to the top of or inside the plug itself.

With explosion of the plug the occurrence of residual parts from the explosion mechanism in the well stream is reduced.

Another great advantage one obtains is when the explosives do not go off and one must install supporting tools to remove the plug. With such a supporting tool the glass plug is often drilled out mechanically.

Firstly, the invention represents a much reduced risk for such a drilling operation unintentionally activating an explosion of the charge, as the essential parts of the ignition mechanisms is not arranged in the plug but in the pipe casing which is not influenced by the drilling.

If it is drilled directly into the explosive charge 55, this will not lead to it exploding, but that it will dissolve when contacting with the well fluid.

If the glass plug gets loose from the seat 21 during drilling so that the explosive charge with the elements 55,56,57 remains intact, the explosion will not happen unintentionally. This is because one is, as a rule, dependent on the function of the elements that lie in the wall of the pipe casing for the explosion to take place.

The invention claimed is:

1. A well plug for performing tests on an elongate wellbore structure enclosing a volume, said plug including a radially disposed channel and a plurality of explosive elements within said channel, said explosive elements comprising an explosive charge and an ignition pin operable to be displaced within said channel for detonation of said explosive charge to remove the plug when said tests are completed, and wherein the elongate structure includes a wedge operable to be moved longitudinally down the elongate structure for contacting onto a rear end of said ignition pin.

2. The plug as claimed in claim 1 characterized in that said plug comprises a casing accommodating said explosive charge and said ignition pin and being inserted in said channel.

3. The plug as claimed in any one of claims 1 and 2 characterized in that said plug comprises two or three casinos for accommodating a corresponding quantity of the explosive charge.

4. The plug as claimed in any one of claims 1 and 2 characterized in that said explosive charge and said ignition pin are implemented in a horizontal direction in a central region of the plug, said horizontal direction being defined as being substantially orthogonal to an elongate axis of the elongate structure when including the plug in operation.

5. The plug as claimed in claim 1 characterized in that the wedge is operable to be moved axially down the elongate structure and wherein the ignition pin is operable to be displaced radially within said channel into an igniter which is operable to explode and thereby detonate said explosive charge.

6. The plug as claimed in any one of claims 1, 2 and 5 characterized in that a diametrically opposite side of said plug comprises corresponding explosive elements.

7. The plug as claimed in any one of claims 1, 2 and 5 characterized in that said plug is fabricated from glass and includes a plurality of explosive elements therein.

8. The plug as claimed in any one of claims 1, 2 and 5 characterized in having a casing containing said explosive elements molded into said plug during manufacture thereof.

9. A method of manufacturing a well plug for performing tests on an elongate wellbore structure enclosing a volume, said method comprising:

(a) including explosive elements in said plug, wherein said explosive elements comprise an explosive charge and which is operable to be detonated to remove the plug when said tests are completed, and (b) integrating components of a detonating mechanism including a longitudinally movable wedge for detonating said explosive charge into a pipe sleeve adapted for the elongate structure.

10. The method of detonating a well plug as claimed in claim 1 for testing an elongate wellbore structure, said method including:

(a) implementing a pipe sleeve of the plug to include a detonating mechanism including the wedge;

(b) operating the wedge to be moved axially down the elongate wellbore structure for contacted onto a read end of the ignition pin which extends into a hollow region in the pipe sleeve; and (c) displacing the ignition pin in operation radially within the cavity into the igniter which is operable to explode and thereby detonate a larger explosive charge within said plug.

11. The combination comprising a well plug for performing tests on an elongate wellbore structure enclosing a volume, said plug including a radially disposed channel;

an explosive charge inserted into said channel, an ignition element in said channel for exploding said explosive charge and an ignition pin in said channel for exploding said ignition element in response to said ignition pin moving against said ignition element, said ignition pin having an end extending outwardly of said plug; and an ignition mechanism including a wedge formed element for movement between a first position spaced from said end of said ignition pin and a second position in engagement with said end of said ignition pin for moving said ignition pin within said channel and into abutment with said ignition element.

12. The combination as set forth in claim 11 further comprising a pipe having said plug mounted horizontally therein with said wedge formed element of said ignition mechanism disposed vertically therein.

* * * * *